US006018845A

United States Patent [19]

Sueki et al.

[11] Patent Number: 6,018,845

[45] Date of Patent: Feb. 1, 2000

[54] VACUUM CLEANER AND SUCTION MEMBER THEREOF

[75] Inventors: Kenzo Sueki, Tondabayashi; Noboru Nishinaka, Wakayama, both of Japan

[73] Assignee: Sharp Kabushiki Kaisha, Osaka, Japan

[21] Appl. No.: 09/057,565

[22] Filed: Apr. 9, 1998

[30] Foreign Application Priority Data

Aug. 29, 1997 [JP] Japan ..... 9-234074

[51] Int. Cl.[7] ..... A47L 5/00

[52] U.S. Cl. ..... 15/375; 15/383; 15/421; 15/182

[58] Field of Search ..... 15/375, 421, 385, 15/383, 363, 366, 23, 24, 27, 179, 182, 183

[56] References Cited

U.S. PATENT DOCUMENTS 1,106,231 8/1914 Marshall .
1,370,256 3/1921 Adams .
2,096,595 10/1937 Sanford .
2,134,396 10/1938 Campbell .
2,159,164 5/1939 Karlstrom .
2,578,549 12/1951 Hooban .

FOREIGN PATENT DOCUMENTS 57-21341 5/1982 Japan .
63-53809 10/1988 Japan .

*Primary Examiner*—William H. Beisner
*Attorney, Agent, or Firm*—Birch, Stewart, Kolasch & Birch, LLP

[57] ABSTRACT

In order to adjust a degree of tight contact between a floor surface and a suction member of a vacuum cleaner, and to facilitate operation of the vacuum cleaner, an air flow adjusting valve is provided at a left end of an upper plate of the suction member. When a negative pressure in an inner chamber reaches to a certain valve, the air flow adjusting valve is opened and air is introduced through an air inlet. This facilitates movement of the suction member over the floor surface.

12 Claims, 4 Drawing Sheets

VACUUM CLEANER AND SUCTION MEMBER THEREOF

BACKGROUND OF THE INVENTION

1. Field of the Invention

The present invention relates to an improvement in a suction member of a vacuum cleaner particularly useful for an upright type vacuum cleaner.

2. Description of the Background Art

Home use vacuum cleaners are mainly classified into canister type ones and upright type ones. An upright type vacuum cleaner is popular as it is easy to handle and is compact.

FIGS. 5 and 6 show the typical structure of the vacuum cleaner. FIG. 5 is a partially cut away side view and FIG. 6 is a perspective view.

A vacuum cleaner body 1 contains a dust chamber 15 and is provided with wheels 2 at the bottom. A fan motor 3 is contained at a lower portion of the body 1. A suction member 4 is rotatedly supported at a lower portion of the vacuum cleaner body 1 by a support shaft (not shown in FIG. 5: denoted by the reference numeral 5 in FIG. 1A). Inside suction member 4, a rotary brush 7 is provided, with tip ends of bristles 8 slightly protruding from a plane of a bottom plate 9-2.

A pulley is fit and fixed at one end of a rotary axis of the rotary brush 7. The rotary brush 7 is rotated by a belt 12 which is driven by a fan motor 9, so that dust in a carpet are raked, and collected to the dust chamber 15 by means of a hose 16. Here, reference numeral 22 denotes a body cover, 23 denotes a handle and 24 denotes a cord.

For cleaning a carpet by such an upright type vacuum cleaner, it is necessary to adjust the height of suction member 4 in accordance with the length of piles of the carpet. When the vacuum cleaner is used on a deep piled carpet, piles of the carpet may possibly enter too deep inside the dust suction inlet 6, and attracted by vacuum pressure, hindering movement of the suction member 4. Effective absorbing power is ensured while not damaging the carpet when the lower surface of the suction member 4 is in contact with the surface of the carpet. When the carpet and the lower surface of the suction member 4 are too heavily in contact with each other, entrance of air flow is hindered, preventing movement of dust and lowering cleaning effectiveness. Further, it becomes difficult to move the suction member 4.

In order to solve this problem, Japanese Patent Publication No. 57-21341 proposes a vacuum cleaner in which a switch lever is moved by a user so as to change the height of a forward wheel provided between the rotary brush and back wheels in the rear portion of the suction member, so that optimal height of the suction member can be selected dependent on the pile length of the carpet. Japanese Patent Publication No. 63-53809 also shows a vacuum cleaner in which height is adjusted by moving upward/downward a forward wheel attached to the suction member portion.

In the technique described in Japanese Patent Publication No. 57-21341, the height is selected by the user dependent on the pile length of the carpet, and therefore adjustment requires some skill and is troublesome. When the vacuum cleaner is operated on a deep piled carpet with the height of the forward wheel not made higher, the degree of vacuum at the suction member becomes too high and the suction member goes deep into the carpet as the lower surface of the suction member cannot be set afloat. Further, the suction member and the carpet are attracted to each other by the vacuum pressure, making it more difficult to move the suction member. This phenomenon of attraction is also experienced at the suction member of a canister type vacuum cleaner.

With regard to the rotary brush itself, the rotary brush is conventionally fabricated by attaching bristles spirally over a surface of a cylindrical roller, and its function is simply to rake out the dust at the surface of the carpet. The rotary energy of the rotary brush has been used only for rotation.

SUMMARY OF THE INVENTION

The present invention was made to solve the above described program, and its primary object is to provide a suction member of a vacuum cleaner which is easy to move.

A secondary object of the present invention is to provide a vacuum cleaner and rotary brush thereof in which energy of rotation of the rotary brush is effectively utilized.

In order to attain the above described objects, in the present invention, an air flow adjusting valve is provided at a wall between the suction member and the outside. The air flow adjusting valve is provided at a portion as far away as possible from a connecting portion between the suction member and the hose, inside the suction member. Further, between the rotary axis and a portion where bristles are provided of the rotary brush, a spiral blade is provided so as to facilitate generation of wind.

As the air flow adjusting valve is provided at the wall between the suction member and the outside, when a negative pressure in a space formed between an inner chamber inside the suction member and the carpet is high, the air flow adjusting valve operates to adjust the negative pressure in the space, whereby the degree of contact with the carpet is maintained at a constant state. This facilitates movement of the suction member.

As the air flow adjusting valve is provided at a position away from the connecting portion between the suction member and the hose, for example, the air flow adjusting valve is provided at one end while the connection portion with the hose is provided at the other end, the air flowing in through the air flow adjusting valve flows entirely over the suction member from the adjusting valve to the connecting portion with the hose. This helps move the dust raked by bristles to the side of the hose.

Further, a blade is provided between the rotary axis and the bristles of the rotary brush, and wind generated by the rotation of the blade further helps movement of dust.

More specifically, according to an aspect of the present invention, the vacuum cleaner includes a dust chamber, a suction member coupled to the dust chamber by a hose, and an air flow adjusting valve provided at a wall between the suction member and outside, so that when a lower surface of the suction member is brought into tight contact with floor surface by wind pressure and negative pressure in said suction member increases, the degree of contact between the lower surface of the suction member and the floor surface is adjusted by air flowing into the suction member through the air flow adjusting valve.

According to another aspect, the suction member of the vacuum cleaner includes an air flow adjusting valve at one end of a wall between a suction member and outside, and a hose connecting portion for communication with a dust chamber of the body of the vacuum cleaner at the other end.

According to a still further aspect, a rotary brush of the vacuum cleaner includes a rotary axis, a spiral blade formed therearound to generate wind, and bristles at a tip end of the blade, with the blade rotated by a motor so as to cause air flow from one to the other direction in the suction member.

According to a still further aspect, the suction member of the vacuum cleaner includes an air flow adjusting valve at one end of a wall between the suction member and outside, a hose connecting portion for communication with a dust chamber of the body of the vacuum cleaner provided at the other end of the wall, adapted such that air is introduced to the suction member when a negative pressure in the suction member increases, and the suction member further includes a rotary brush inside the suction member, the brush including a rotary axis, a spiral blade formed therearound and bristles at a tip end of the blade, and by the rotation of the blade driven by a motor, air flow is generated from the aforementioned one end to the aforementioned other end, in the suction member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1A:
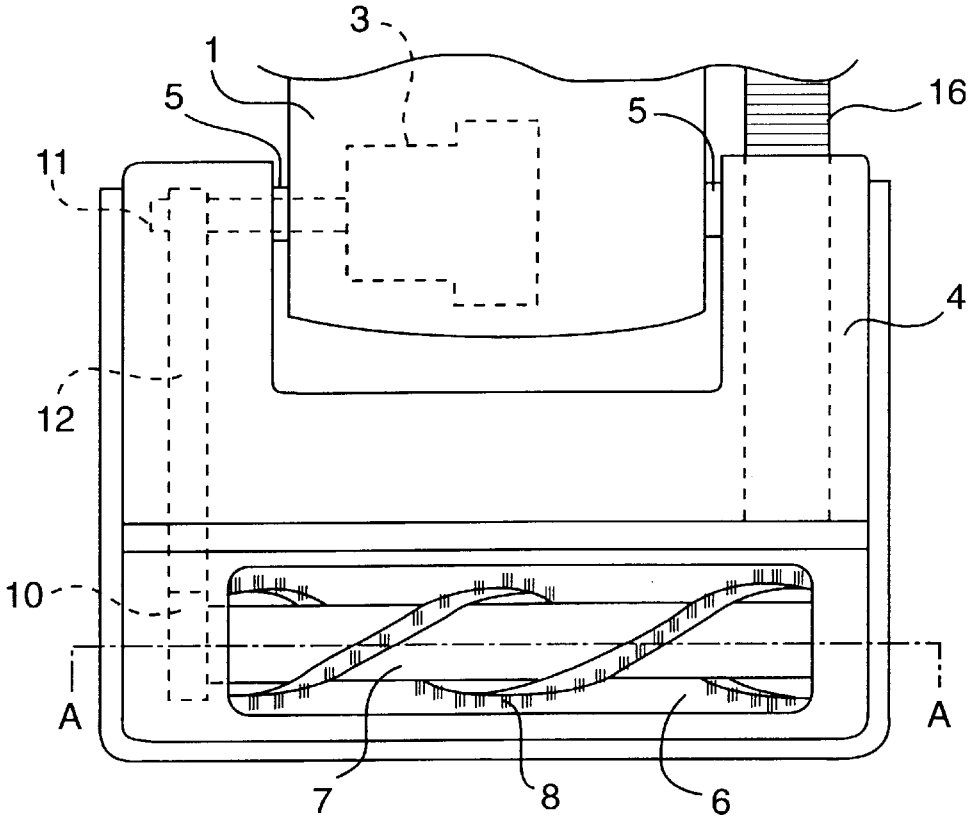
FIG. 1A is a bottom view of a suction member in accordance with the present invention.
Figure 1B:
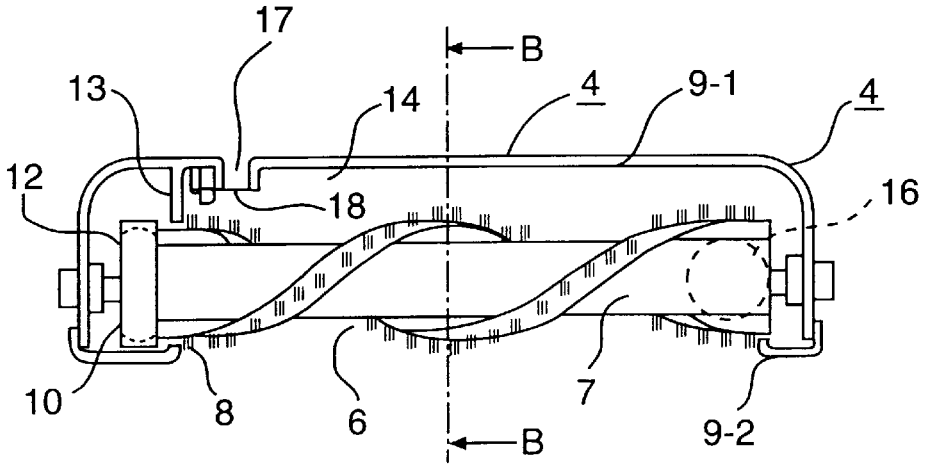
FIG. 1B is a cross section taken along the line A—A of FIG. 1A.
Figure 5:
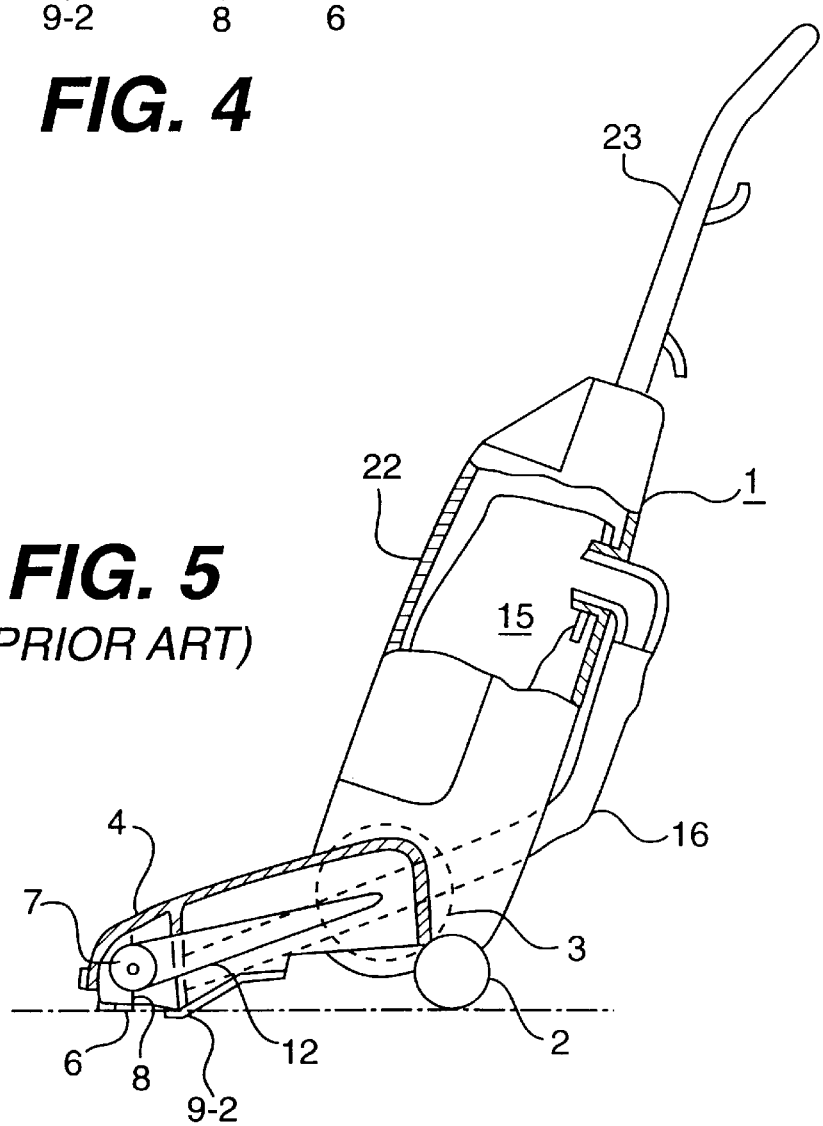
FIG. 5 (PRIOR ART)
FIG. 5 is a partially cut away side view of a conventional upright type vacuum cleaner.
Figure 6:
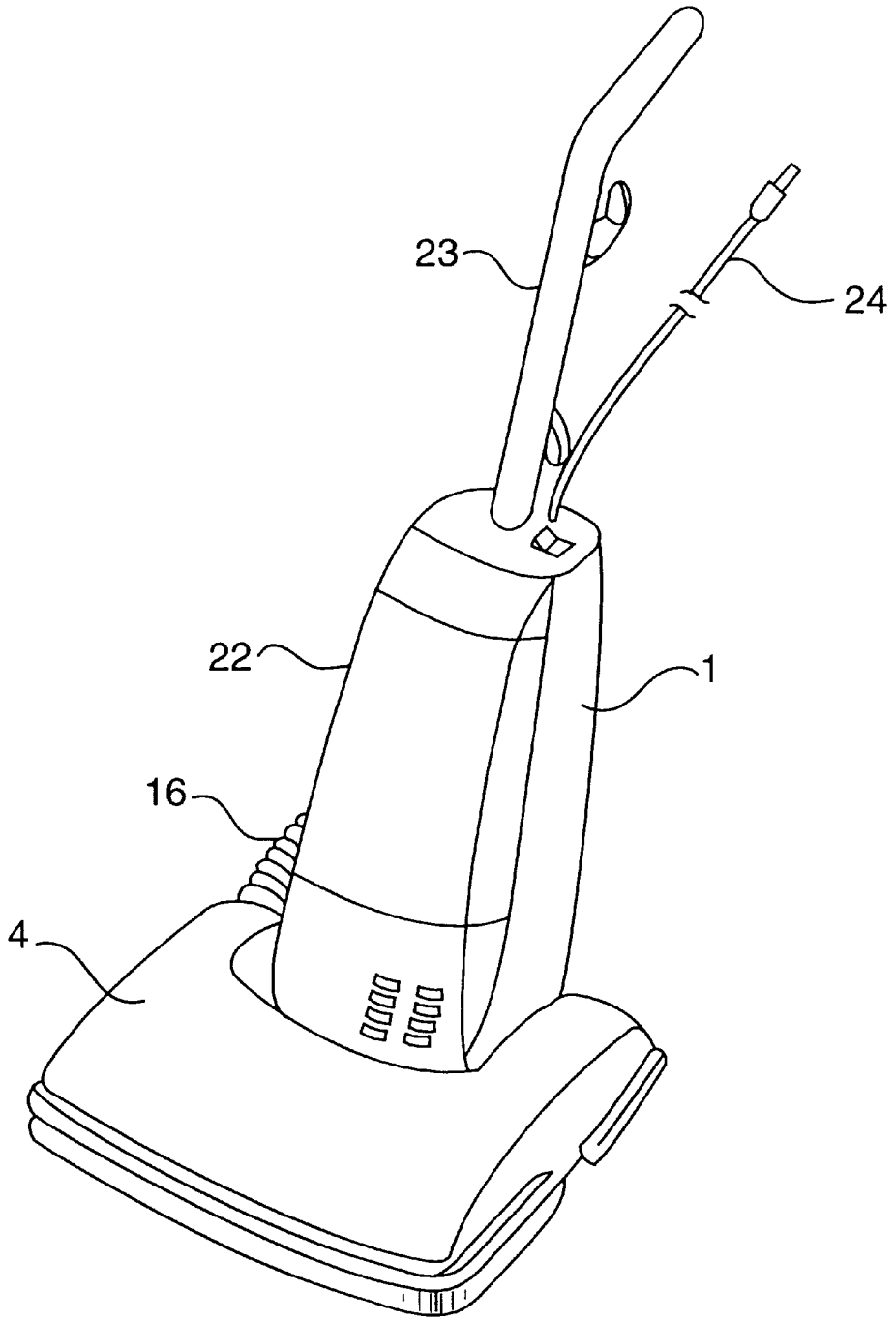
FIG. 6 (PRIOR ART)
FIG. 6 is a perspective view of the conventional upright type vacuum cleaner.

FIG. 1A is a bottom view of the suction member and FIG. 1B is a cross section taken along the line A—A of FIG. 1A. Appearance and the like of the vacuum cleaner are the same as shown in FIGS. 5 and 6. Therefore, description thereof is not repeated.

Suction member 4 is rotatably supported at a lower portion of vacuum cleaner body 1 by a support shaft 5. Rotation of fan motor 3 is transmitted to rotary brush 7 through a motor axis 11, a belt 12 and a pulley 10, and bristles 8 provided spirally on an outer periphery of the rotary brush 7 rake dust on the surface of the carpet. Hose 16 connected to a right side of suction member 4 absorbs air and dust from dust inlet 6 by a negative pressure generated by fan motor 3, and transmits the dust to a dust chamber.

An outer wall of suction member 4 includes an upper plate 9-1 which is a wall against the outside and a bottom plate 9-2 which is brought into contact with the surface of the carpet. Dust inlet 6 is opened in bottom plate 9-2. Between dust inlet 6 and a driving portion including belt 12 and pulley 10, a partition 13 is provided adjacent to but not in contact with bristles 8. This prevents reduction in wind pressure at dust inlet 6. A space containing rotary brush 7 between upper plate 9-1 and bottom plate 9-2 will be referred to as an inner chamber 14.

An air inlet 17 is opened at a left portion at upper plate 9-1, and air flow adjusting valve 18 is provided inside.

Figure 2:
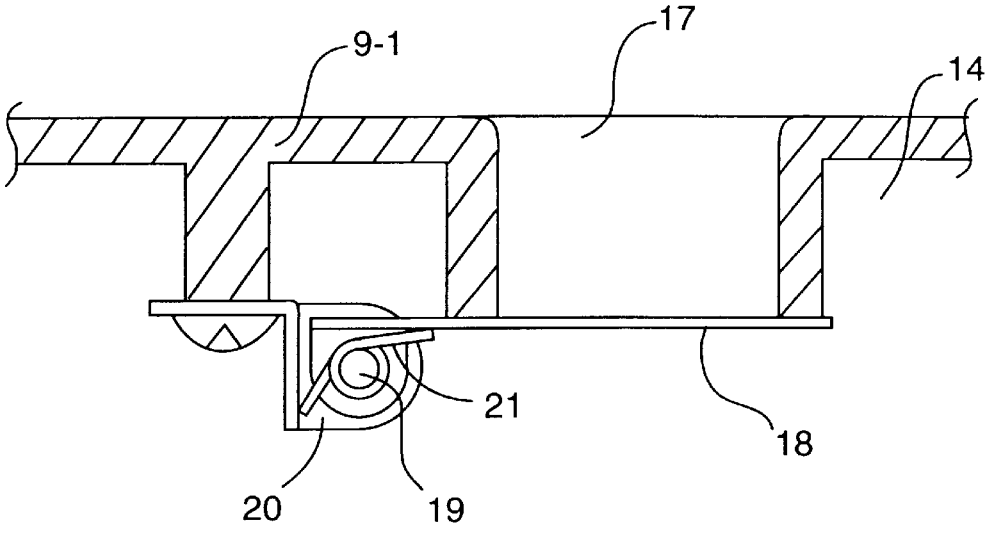
FIG. 2 is a cross section of an air flow adjusting valve in a closed state.
Figure 3:
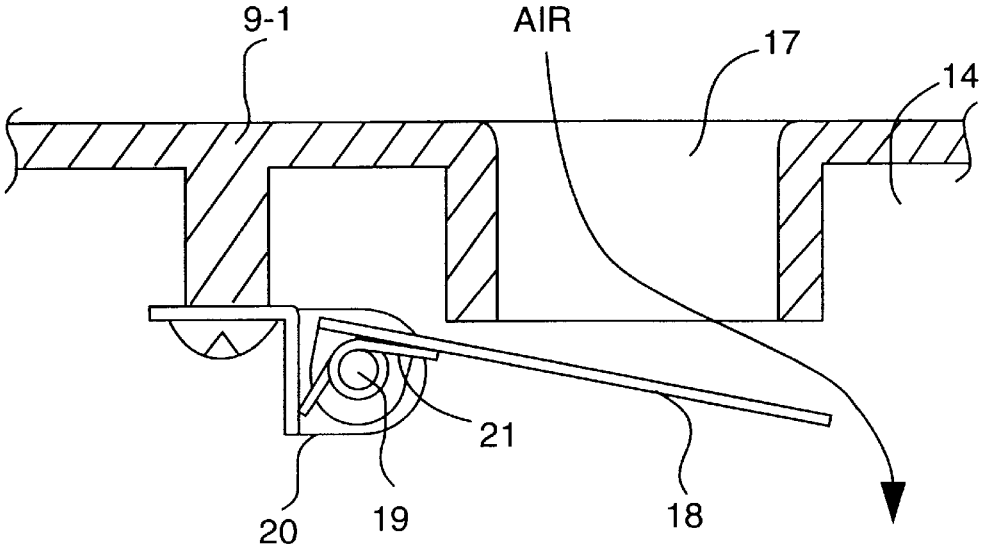
FIG. 3 is a cross section of the air flow adjusting valve in an open state.

FIGS. 2 and 3 are cross sections of a main portion with air flow adjusting valve 18 in a close state and open state, respectively. A base portion of air flow adjusting valve 18 provided inside air inlet 17 for opening/closing the air inlet is pivotally supported by a support axis 19 of a base 20, and by a valve pressing spring 21, it is adapted to normally close air inlet 17 when the negative pressure does not reach a prescribed pressure. The pressure of valve pressing spring 21 may be adjustable. Therefore, a threshold value of the pressure for opening/closing the valve may be adjusted.

When the vacuum cleaner is in operation, the plane of dust inlet 6 is in contact with the floor surface and hence the inlet is closed rather tightly. When the carpet is deep piled, for example, negative pressure of inner chamber 14 increases. If the spring pressure of valve pressing spring 21 is adjusted in advance so that opening angle of air flow adjusting valve 18 varies in accordance with the negative pressure, the amount of air entering from air inlet 17 of suction member 4 varies. Accordingly, the degree of contact between the suction member and the carpet is maintained at an appropriate constant state. For example, when the carpet is deep piled, the degree of tight contact with the dust inlet 6 increases, amount of air introduced through air inlet 17 increases, and as a result, the degree of contact is released.

As to the positional relation between air flow adjusting valve 18 and the connecting portion of hose 16 and suction member 4, when air flow adjusting valve 18 is provided at a left end of inner chamber 14 and the connection to the hose 16 is provided at a right end of inner chamber 14 as shown in FIG. 1B, the air absorbed through air inlet 17 moves from left to the right entirely over the dust inlet 6, and therefore movement of dust raked by bristles 8 to the hose 18 is facilitated.

By improving the shape of rotary brush 7 to feed wind to the direction of the connecting portion between the suction member and hose 16, efficiency can further be improved.

Figure 4:
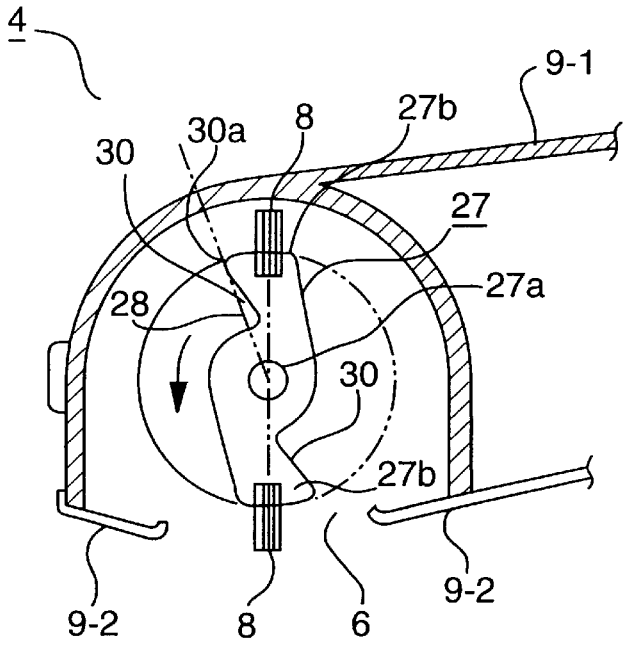
FIG. 4 is a cross section of an improved rotary brush in accordance with the present invention.

FIG. 4 is a cross section of suction member 4 having the rotary brush of an improved shape. This figure corresponds to the cross section B—B of FIG. 1B.

In a space formed by upper plate 9-1 and bottom plate 9-2 of suction member 4, a rotary brush 27 is provided. Rotary brush 27 includes a rotary brush axis 27*a* and a plurality of, for example two, spiral blades 27*b* and 27*b* protruding outward from the axis. Bristles are provided at tip ends of the blades, and tip ends of bristles 8 are adapted to be protruded slightly downward from the plane of dust inlet 6 opened at bottom plate 9-2. Positional relation between the hose and the rotary brush is the same as that shown in FIG. 1B. When rotary brush 27 rotates in the direction of the arrow in FIG. 4, the wind generated by blade 27*b* flows to the connecting portion between the hose and the suction member. Blade 27*b* has sufficient length and appropriate cross section to facilitate generation of wind when it is rotated. By providing a sufficient space between the rotary brush axis 27*a* and the tip end of blade 27*b*, generation of wind is facilitated and air and dust can be moved without any resistance to the connecting portion with the hose, and therefore higher performance of collecting dust is possible. Since a forward surface 30 is curved inward such that the forward surface 30 is located inwardly of a line extending from the tip end 30*a* of the forward surface to the axis of rotary brush 27, the wind generated by the rotation of the rotary brush can be increased and made stronger. Since the wind generated by the rotation of the rotary brush acts in addition to the absorbing power from the hose, performance of collecting dust is further improved. In short, a concave portion should desirably be formed in a direction opposite to the direction of rotation.

The spiral structure of blade 27*b* is as shown in FIGS. 1A and 1B, for example, and the wind flows from the left to the right by the spiral.

The rotary brush having such an improved shape may be used in the conventional upright type vacuum cleaner. It is more effective, however, when the brush is applied to the upright type vacuum cleaner having the above described air flow adjusting valve.

The present invention may be applied to a canister type vacuum cleaner. However, in that case, the rotary brush should be driven by a motor.

As described above, in the present invention, an air flow adjusting valve is provided. Accordingly, the inconvenience of difficulty in moving an upright type vacuum cleaner experienced by the prior art vacuum cleaner when a deep-piled carpet, for example, is cleaned can be avoided, as the degree of contact of the suction member can automatically be adjusted appropriately by the air introduced from the air flow adjusting valve. Operation of the vacuum cleaner is easier and more convenient, as it is not necessary for the user to adjust taking into consideration the length of pile of the carpet.

The base of the rotary brush on which bristles are provided, which has been merely a rotating body in the prior art, is adapted to have a blade shaped. Therefore, the rotary brush generates wind to feed dust to the side of the hose. Therefore, efficiency in operation of the vacuum cleaner is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A vacuum cleaner comprising:

a dust chamber;

a suction member including a housing;

a rotary brush located within said housing;

a hose located in said housing adjacent one end of said rotary brush for coupling said suction member to the dust chamber; and an air flow adjusting valve provided in a wall of said housing adjacent the other end of said rotary brush for allowing air to flow into said housing from outside of said housing, wherein when a lower surface of the suction member is brought into tight contact with a floor surface by suction pressure and negative pressure in said suction member increases, a degree of tight contact between the lower surface of said suction member and said floor surface is adjusted by air introduced through said air flow adjusting valve into said suction member, said air flowing across said rotary brush and into said hose to assist in the removal of dust particles from said rotary brush.

2. The vacuum cleaner according to claim 1, wherein said vacuum cleaner is an upright type vacuum cleaner.

3. The vacuum cleaner as set forth in claim 1, wherein said air flow adjusting valve comprises a flap pivotally mounted to said housing, and a spring for biasing said flap to a closed position.

4. A suction member for a vacuum cleaner comprising:

a housing;

a rotary brush located within said housing;

an air flow adjusting valve provided in a wall of said housing adjacent one end of said rotary brush for allowing air to flow into said housing from outside of said housing; and a hose connecting portion located in said housing adjacent the other end of said rotary brush for communicating with a dust chamber in a vacuum cleaner body, wherein said air flows into said air flow adjusting valve, across said rotary brush, and into said hose connecting portion.

5. The suction member for a vacuum cleaner according to claim 4, wherein said rotary brush comprises a spiral blade formed therearound for generating wind when rotated to produce an air flow from one end of said rotary brush to the other end of said rotary brush; and a plurality of bristles located at a tip end of said blade.

6. A vacuum cleaner having a suction member according to claim 5.

7. The suction member for a vacuum cleaner as set forth in claim 4, wherein said air flow adjusting valve comprises a flap pivotally mounted to said housing, and a spring for biasing said flap to a closed position.

8. A rotary brush of a vacuum cleaner comprising a rotary axis, a spiral blade formed therearound for generating wind, and bristles at a tip end of said blade, wherein said blade is rotated by a motor whereby air is fed from one to another direction in a suction member, and wherein a concave portion facing in a direction opposite to a direction of rotation of said rotary brush is formed in cross section of said blade.

9. A vacuum cleaner having a rotary brush according to claim 8.

10. A suction member for a vacuum cleaner comprising:

a housing;

an air flow adjusting valve provided at one end of said housing in a wall thereof for allowing air to flow into said housing from outside of said housing when negative pressure in said suction member increases;

a hose connecting portion located at the other end of said housing for communicating with a dust chamber in a vacuum cleaner body;

a rotary brush located within said housing and rotatable about a rotary axis, said rotary brush including at least one spiral blade formed therearound, and a plurality of bristles located along a tip end of the blade; and a motor for rotating said rotary brush about said rotary axis such that said at least one blade produces an air flow from said air flow adjusting valve at said one end of said housing to said hose connecting portion at said other end of said housing and across said rotary brush to assist in the removal of dust particles from said plurality of bristles of said rotary brush.

11. A vacuum cleaner having a suction member according to claim 10.

12. The suction member for a vacuum cleaner as set forth in claim 10, wherein said air flow adjusting valve comprises a flap pivotally mounted to said housing, and a spring for biasing said flap to a closed position.

* * * * *